United States Patent [19]

Leichle

[11] 4,040,397

[45] Aug. 9, 1977

[54] CONTROL OF ELECTROMAGNETIC FUEL INJECTORS IN INTERNAL COMBUSTION ENGINES

[75] Inventor: Claude Leichle, Le Pecq, France

[73] Assignees: Regie Nationale des Usines Renault, Boulogne-Billancourt; Automobiles Peugeot, Paris, both of France

[21] Appl. No.: 610,775

[22] Filed: Sept. 5, 1975

[30] Foreign Application Priority Data

Sept. 9, 1974 France ..... 74.30510

[51] Int. Cl.[2] ..... F02B 3/00

[52] U.S. Cl. ..... 123/32 AE; 123/32 EA

[58] Field of Search ..... 123/32 EA, 32 AE; 317/DIG. 4, DIG. 6

[56] References Cited

U.S. PATENT DOCUMENTS

| | | | |
|---|---|---|---|
| 3,243,505 | 12/1966 | Miller | 317/DIG. 4 |
| 3,549,955 | 12/1970 | Paine | 317/DIG. 4 |
| 3,590,334 | 6/1971 | Baker | 317/DIG. 4 |
| 3,613,644 | 10/1971 | Porsche | 123/32 EA |
| 3,750,631 | 8/1973 | Scholl et al. | 123/32 EA |
| 3,786,314 | 1/1974 | Misch | 317/DIG. 4 |
| 3,786,344 | 1/1974 | Davis et al. | 123/32 EA |
| 3,909,701 | 9/1975 | Waehner | 317/DIG. 4 |

*Primary Examiner*—Carroll B. Dority, Jr.
*Assistant Examiner*—Paul Devinsky
*Attorney, Agent, or Firm*—Owen, Wickersham & Erickson

[57] ABSTRACT

The operation of each electromagnetic fuel injector of an internal combustion engine is controlled so that when an energizing current is caused to flow from the battery of the engine through the coil of the fuel injector, the time taken for the current to reach its full value is controlled electronically so that it is a constant irrespective of the battery voltage but no shorter than would naturally result if the battery were to deliver its predicted lowest voltage directly to the coil, the necessary control being obtained by generating a constant electric current and using it to charge a capacitor to a predetermined voltage, comparing the voltage of the capacitor with a voltage which is proportional to the energizing current flowing through the coil, and controlling the build up time of the energizing current so that it is equal to the time taken to charge the capacitor, this being constant.

11 Claims, 4 Drawing Figures

CONTROL OF ELECTROMAGNETIC FUEL INJECTORS IN INTERNAL COMBUSTION ENGINES

Figure 1:
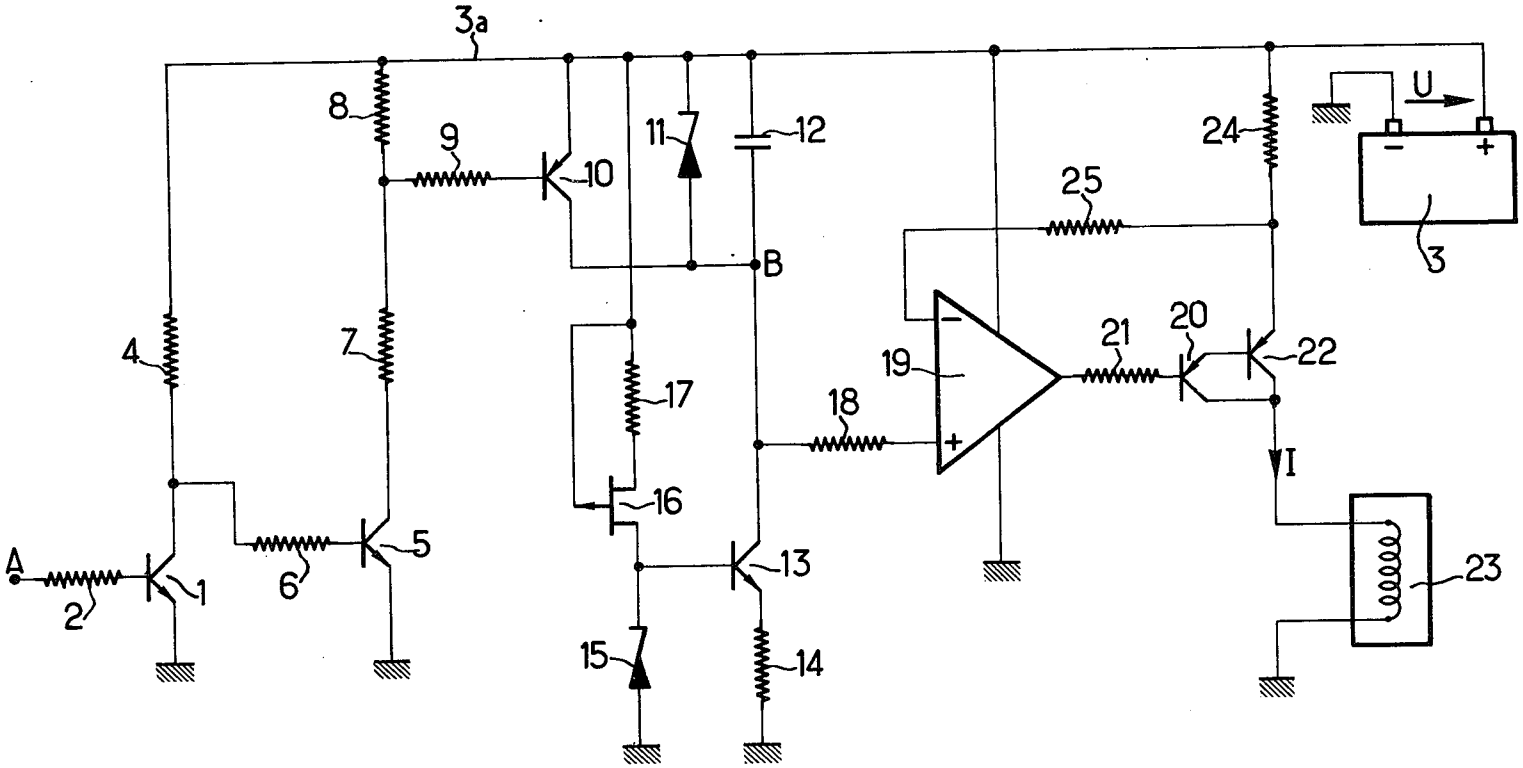

The present invention relates to the control of electromagnetic fuel injectors in internal combustion engines.

Fuel injectors in internal combustion engines must be capable of injecting precisely controlled quantities of fuel into the combustion chambers of the engine. Each injector delivers fuel through an outlet valve, and as long as the outlet valve is fully open the injector can be assumed to deliver fuel at a constant rate. If the valve were always to be either fully open or fully closed, then the quantity of fuel delivered would be strictly proportional to the period during which the valve is open. But in reality the valve takes a certain length of time to open fully and consequently the proportionality remains strictly true only as long as the valve opens with the same rapidity each time. In electromagnetic fuel injectors the valve is opened by an electromagnetic coil. A coil of this kind has a certain auto-inductance, with the result that the current flowing through the coil builds up, when a constant driving voltage is applied, following an exponential curve. The slope at the beginning of this curve is a function of the applied voltage.

In a motor vehicle electromagnetic fuel injectors are powered by the vehicle battery, whose delivered voltage may vary over a wide range due to variations in a number of operating parameters, such as temperature, number of devices powered, and so on, the battery voltage jumping, for example, to quite a different value when the headlights are switched on. Variations in battery voltage greatly influence the behaviour of the fuel injectors, or more precisely the response time of their electromagnetic valves. To ensure that each injector regularly delivers the desired quantity of fuel it is therefore necessary to compensate for variations in battery voltage.

One possible method for obtaining a constant voltage for operating the fuel injectors would of course be to introduce ballast into the circuit containing the injector valves, so as to keep the applied voltage constantly at its lowest predicted value. The main disadvantage of this method is that it would involve an unacceptable loss of power through the ballast.

Another known method for compensating variations in battery voltage involves using a computer for controlling the functioning of the injectors. The computer contains a device which controls the duration of opening of each injector valve on the basis of the voltage actually applied, at each instant, and the characteristics of the injector. But although this method can ensure the desired precision in the quantity of fuel injected, a complex apparatus is required which has to measure the applied voltage at each instant and calculate from this the appropriate opening period for the injector.

According to the present invention a method of controlling the functioning of an electromagnetic fuel injector in an internal combustion engine comprises generating a constant electric current and using it to charge a capacitor up to a predetermined voltage when the electromagnetic coil of the injector is energised by the engine battery, comparing the voltage of the capacitor with a voltage which is proportional to the electric current flowing through the coil, and electronically controlling the build-up time of the coil current, that is the time taken for the current flowing through the coil to reach its full value, so that the build-up time is a constant equal to the time taken to charge the capacitor and no shorter than would naturally result were the battery to deliver its predicted lowest voltage directly to the coil.

This ensures that the rapidity of opening of the injector valve is entirely independent of the voltage available from the vehicle battery. Equally, the response time of the injector is not influenced by characteristics of the injector, such as its thermal behaviour or variations in the parasite resistance of the coil.

According to a further aspect of the invention, a control device for carrying out the method comprises a comparator having a pair of input terminals, a resistor which is connected to one of the input terminals of the comparator and which is arranged to be series connected to the coil of the fuel injector, a capacitor which is connected to the other terminal of the comparator and which is also connected to a current generator which is arranged to provide a constant charging current, and means which is connected to the capacitor for limiting the maximum charge on the capacitor to a predetermined fixed value.

Figure 2A:
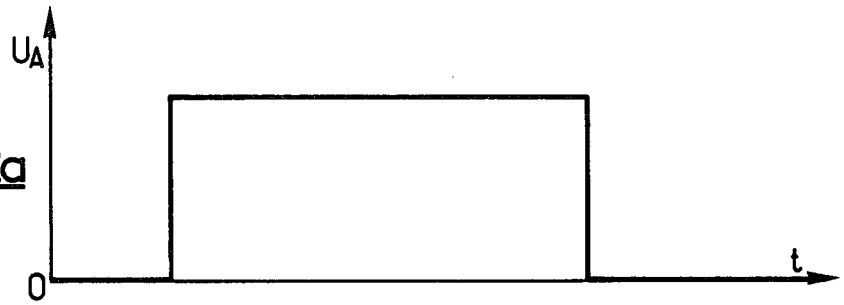
Figure 2B:
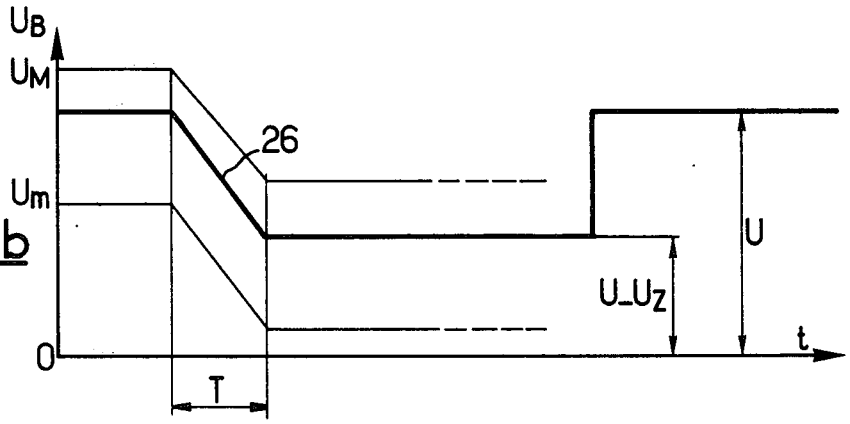
Figure 2C:
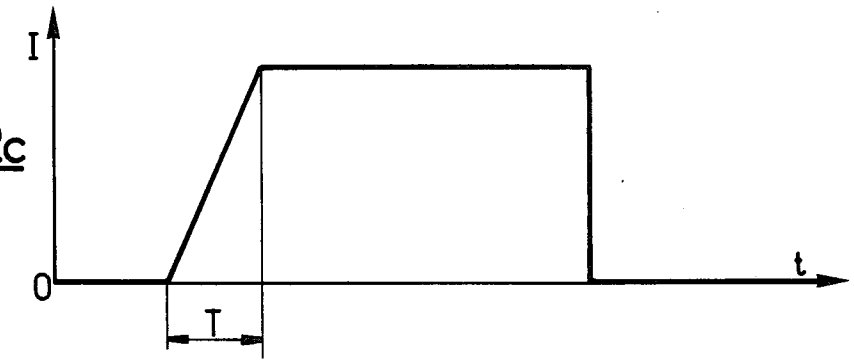

Such a control device is simple in construction and does not make it necessary to measure the battery voltage applied to the injector at any instant. The device is economical in operation and imposes a minimal drain on the battery since its operation is restricted to the period during which the current flowing through the injector coil is increasing. An example of a control device and its method of operation in accordance with the invention will now be described with reference to the accompanying drawings, in which:

FIG. 1 shows an electrical circuit diagram of a control device for controlling one of the fuel injectors of an internal combustion engine; and, FIGS. 2*a*, 2*b* and 2*c* are diagrams showing voltage against time curves appropriate to different points in the circuit of FIG. 1. The circuit shown in FIG. 1 illustrates the general arrangement of the control device, and comprises a transistor 1 having its base connected through a resistor 2 to a signal input terminal A of the circuit which is arranged to receive the signal commanding the fuel injector to operate, i.e. its valve to open. The emitter of the transistor 1 is directly connected to earth. An accumulator 3, that is to say the vehicle battery, also has its negative pole connected directly to earth. The battery 3 provides the working voltage for the circuit. The collector of the transistor 1 is connected through a resistor 4 to a power line 3*a*, which is itself connected to the positive pole of the battery 3.

The collector of the transistor 1 is also connected through a resistor 6 to the base of a further transistor 5, whose emitter is connected directly to earth. The collector of the transistor 5 is connected through two resistors 7 and 8 in series to the power line 3*a*. A point on the line between the two resistors 7 and 8 is connected through a resistor 9 to the base of a transistor 10 whose emitter is connected directly to the power line 3*a*. The collector of the transistor 10 is connected to a terminal B. The terminal B is also connected to the power line 3*a* through two lines in parallel, one containing a Zener diode 11, and the other containing a capacitor 12. Each of these lines is in parallel with the emitter-collector path of the transistor 10.

The emitter of a further transistor 13 is connected through a resistor 14 to earth. The collector of the transistor 13 is connected directly to the terminal B. The base of the transistor 13 is connected, on the one hand, to earth through a Zener diode 15 and, on the other hand, to the drain of a field-effect transistor 16 whose gate electrode is directly connected to the power line *3a*. The source electrode of the field-effect transistor 16 is connected through a resistor 17 to the power line *3a*.

The collector of the transistor 13 is also connected through a resistor 18 to the non-inverting (+) input terminal of a voltage comparator 19 interposed between the positive power line *3a* and earth. The output terminal of the comparator 19 is connected through a resistor 21 to the base of a transistor 20, which itself controls a transistor 22 by a Darlington connection. That is to say, the emitter of the transistor 20 is connected directly to the base of the transistor 22, whereas the collector of the transistor 20 is connected directly to the collector of transistor 22. The collector of the transistor 22 is also connected to earth through the coil of the electromagnet of the fuel injector 23 which it is intended to control. The emitter of the transistor 22 is connected through a resistor 24 to the power feed line *3a* of the battery 3 and is also connected through a resistor 25 to the inverting (−) input terminal of the comparator 19. When the injector is actuated a current I flows through the coil 23.

The device illustrated in FIG. 1 functions as follows: A command signal $U_A$, whose behaviour is represented in FIG. *2a*, commanding the injector 23 to open, is applied to the signal input terminal A, reaching the base of the transistor 1. The signal is inverted on the collector of the transistor 1 and, through the transistor 5 and resistors 7, 8, 9, makes the transistor 10 non-conductive. When there is no signal at the terminal A, the transistor 10 is saturated. When the transistor 10 is blocked, the terminal B has the same voltage as the power line *3a*, as indicated at U in FIG. *2b*. The voltage on the terminal B can therefore change with the charge on the capacitor 12. The capacitor 12 is charged through the transistor 13, in that the capacitor 12, the transistor 13, the field-effect transistor 16, the Zener diode 15 and the resistors 17 and 14 together form a constant current generator. The transistor 16 feeds current to the Zener diode 15, which acts as a reference for the current generator containing the transistor 13. This double regulation is necessary to ensure that the voltage at the terminal B is largely independent of the power line voltage supplied by the battery 3.

The capacitor 12 charges up as far as the Zener voltage of the diode 11. After that, no further charging takes place. The voltage on the capacitor 12 returns to zero as soon as the transistor 10 becomes saturated again, that is to say when the command signal at the terminal A returns to zero.

The voltage at the terminal B, as shown in FIG. *2b*, varies between + U (the voltage supplied by the battery) and $U - U_z$, the voltage $U_z$ being the Zener voltage of the diode 11. In FIG. *2b* the slope of the line 26 is a function of the rate of charging of the capacitor 12, which itself depends on the value of the capacitor 12 and on the constant current supplied by the transistor 13. Consequently, for a given capacitor 12 and a given current generator (consisting of the transistors 13 and 16, the Zener diode 15 and the resistors 14 and 17) the slope has a fixed value. Furthermore, the voltage difference $U - U_z$ is also a fixed quantity, the Zener voltage $U_z$ being fixed. As a result, the time T taken for the voltage at the terminal B to change from U to $U - U_z$ is constant and independent of the value of the voltate U supplied by the vehicle battery 3, provided of course that U is always greater than $U_z$.

To sum the matter up, the circuit consisting of the comparator 19, the transistors 20 and 22, the resistors 18, 21, 24 and 25 and the coil 23 of the fuel injector, functions as a slave voltage-to-current transducer which sends through the injector coil 23 a current which is inversely proportional to the voltage at the terminal B. The circuit functions as follows: As soon as the voltage across the resistor 24 (this is the voltage applied to the inverting input terminal of the comparator 19) differs from the voltage between the terminal B and earth (this is the voltage applied to the non-inverting input terminal of the comparator 19), the comparator generates an error signal and delivers through its output terminal a corrected signal, i.e. a signal corrected in dependence on the error signal. The corrected signal is amplified by the transistors 20 and 22 and the amplified signal controls the current I which actuates the fuel injector of the engine. It will be observed that the injector coil 23 is connected in series with the resistor 24. The voltage across the resistor 24 is therefore proportional to the current I flowing through the coil 23 and consequently the signal reaching the inverting input terminal of the comparator 19 is proportional to the current I (which depends on the voltage across the coil). Consequently, the comparator 19 is able to modify its output signal from one instant to the next in such a way that the change in the current I faithfully follows the change in the voltage at the terminal B. As a result, the time taken by the current I to increase from zero to its highest value is the time T taken by the voltage at the terminal B to decrease from U to $U - U_z$, the time T being a constant, as explained above. In practice it is desirable to make the constant time interval T as short as possible, although there is a lower limit determined by the characteristics of the injector and the kind of battery used.

Let it be assumed that the voltage delivered by the vehicle battery 3 can vary between a highest voltage $U_M$ and a lowest voltage $U_m$. If no control device is used, the time taken before the full current I flows through the injector coil 23 can be calculated for all battery voltages between these two limits, including the lowest battery voltage $U_m$. To allow for the lowest predicted battery voltage $U_m$, the device in accordance with the invention is therefore arranged to give a time interval T (this is the time taken for the current I to reach its full value) which is slightly less than that which corresponds to the lowest predicted battery voltage $U_m$. It will be recalled that the time interval T, using the device in accordance with the invention, depends exclusively on the Zener voltage of the diode 11, on the value of the capacitor 12, and on the characteristics of the devices forming the current generator. Consequently, the time taken for the current I to reach its full value remains practically constant and always sufficient for the correct functioning of the injector, irrespective of variations in battery voltage over the range between $U_M$ and $U_m$, which is exactly the result desired. The control device itself involves very little power loss.

In some known arrangements for controlling the current supplied to the fuel injectors a pre-magnetization current is applied to each injector before it is due to open. A device in accordance with the present invention may be adapted to supplement arrangements of this kind, the device controlling the rate of increase of the main current, so that the advantages of the two systems are obtained.

I claim:

1. A control device for controlling the initiation operation of an electromagnetic fuel injector in an internal combustion engine having a storage battery, said fuel injector having a coil, comprising: voltage comparator means, first and second input terminals on said voltage comparator means, a resistor connected to said first input terminal, means for series connecting said resistor to said coil of said fuel injector, a capacitor connected to said second input terminal, electric current generator means for generating a constant electric current, means connecting said electric current generator means to said capacitor for causing said constant electric current to charge said capacitor, and limiting means connected to said capacitor for limiting the maximum charge of said capacitor to a predetermined fixed value, whereby the build-up time for said fuel injector coil is retained constant, regardless of changes in voltage supplied by said storage battery.

2. A control device as claimed in claim 1, wherein said electric current generator means comprises at least two transistors, one of said at least two transistors being adapted to deliver said constant output electric current of said generator means, at least one Zener diode for fixing the base voltage of said transistor which delivers said output electric current, and at least one load resistor for each of said two transistors, said electric current generator means providing said constant output electric current from a variable power supply irrespective of large variations in the voltage of said power supply.

3. A control device as claimed in claim 1, further comprising means for supplying a relatively weak electric current to said coil of said fuel injector in order to premagnetise said coil before said injector is commanded to operate.

4. A control device for controlling the operation of an electromagnetic fuel injector in an internal combustion engine having an electrical storage battery, said fuel injector having a coil, comprising: voltage comparator means, first and second input terminals on said voltage comparator means, a resistor connected to said first input terminal, means for series connecting said resistor to said coil of said fuel injector, a capacitor connected to said second input terminal, electric current generator means for generating a constant electric current, means connecting said electric current generator means to said capacitor whereby said constant electric current charges said capacitor, and limiting means connected to said capacitor for limiting the maximum charge of said capacitor to a predetermined fixed value, said limiting means being a Zener diode connected in parallel with said capacitor.

5. A control device as claimed in claim 4, including a semi-conductor device for switching the charging and discharging of said capacitor.

6. A control device as claimed in claim 5, wherein said semi-conductor device is a transistor.

7. A control device as claimed in claim 5, further comprising at least two transistors for converting a command signal which commands said fuel injector to operate into a signal which blocks or unblocks said transistor which switches the charging and discharging of said capacitor.

8. In an internal combustion engine including an electrical storage battery, an electromagnetic fuel injector, a coil of said electromagnetic fuel injector, and means for causing an energising electric current to flow from said battery through said coil to operate said fuel injector, the improvement comprising of a control device for controlling the build-up time of said energising electric current flowing through said coil, that is the time taken for said energising electric current to reach its full value, so that said build-up time is a constant irrespective of the voltage of said battery, said control device comprising voltage comparator means, first and second input terminals of said voltage comparator means, a resistor connected to said first input terminal, means also connecting said resistor in series with said coil of said fuel injector, a capacitor connected to said second input terminal, constant electric current generator means for generating a constant electric current from said battery, means connecting said constant electric current generator means to said capacitor, means for causing said constant electric current to charge said capacitor when said energising current is caused to flow through said coil, and means connected to said capacitor for limiting the maximum charge of said capacitor to a predetermined fixed value, whereby the time taken to charge said capacitor to its maximum charge is constant and said build-up time of said energising electric current is controlled to equal said time taken to charge said capacitor.

9. In an electrical circuit for an internal combustion engine having an electromagnetically energized fuel injector, having the combination of:

1. a storage battery having an output and a ground,
2. a coil for actuating and de-actuating said fuel injector,
3. a constant-current generator comprising:
   a. a condenser and a first Zener diode connected in parallel with each other and connected on one side to said storage battery output and on the other side to a first terminal,
   b. a first NPN transistor having a collector connected to said first terminal, an emitter connected through a resistor to said storage battery ground, a base,
   c. a second, P-channel field-effect transistor having a gate electrode connected to said storage battery output, a source electrode connected through a resistor to said storage battery output, and a drain electrode connected to said base of said first transistor and through a second Zener diode, to said storage battery ground,
4. a normally saturated PNP third transistor having an emitter connected to said storage battery output, a collector connected to said first terminal, and a base,
5. transistorized blocking means having an output connected to said base of said third transistor and an input connected to a second terminal for reception of signals therefrom, for making said third transistor non-conductive only when receiving a said signal,
6. voltage comparator means connected between said storage battery output and said storage battery ground and having a non-inverting input terminal connected to said first terminal and an inverting input terminal connected through a resistance to said storage battery output, and an output terminal, and 7. a PNP Darlington connected pair of transistors, being fourth and fifth transistors, with
   a. said fourth transistor having a base connected to said output terminal of said voltage comparator means, through a resistor, an emitter connected directly to the base of said fifth transistor, and a collector connected to the collector of said fifth transistor and to said coil, the other end of said coil being connected to said battery ground,
   b. said fifth transistor having an emitter connected through a resistance to said inverting input terminal and connected through another resistance to said storage battery output.

10. The combination of claim 9 wherein said transistorized blocking means comprises:

a sixth NPN transistor having its base connected to said second terminal through a resistance, an emitter connected to said battery ground, and a collector connected through a resistance to said battery output, and a seventh NPN transistor having its base connected through a resistance to the collector of said sixth transistor, an emitter connected to said battery ground, and a collector connected, through a resistance network both to said battery output and to the base of said third transistor.

11. A method for controlling the initiation operation of an electromagnetic fuel injector in an internal combustion engine having an electrical storage battery, said fuel injector including an electromagnetic coil, the method comprising the steps of causing an energising electric current to flow through said coil of said fuel injector from said battery, providing constant electric current generating means and a capacitor, generating a constant electric current from said constant electric current generating means, using said constant electric current to charge said capacitor to a predetermined voltage, obtaining a first voltage signal corresponding to the voltage of said capacitor, obtaining a second voltage signal proportional to said energising electric current flowing through said coil, comparing said first and second voltage signals, and electronically controlling the build-up time of said energising electric current flowing through said coil, that is the time taken for said energising electric current to reach its full value, to hold said build-up time to a constant, regardless of changes in voltage supplied by said storage battery, being equal to the time taken to charge said capacitor and no shorter than would naturally result if said battery were to deliver its predicted lowest voltage directly to said coil.

* * * * *